US007891424B2

(12) United States Patent
Creel et al.

(10) Patent No.: US 7,891,424 B2
(45) Date of Patent: Feb. 22, 2011

(54) METHODS OF DELIVERING MATERIAL DOWNHOLE

(75) Inventors: Prentice G. Creel, Odessa, TX (US); B. Raghava Reddy, Duncan, OK (US); Eldon D. Dalrymple, Duncan, OK (US); Ramzi I. Abdulkadir, Ghubra (OM); James J. Venditto, Richmond, TX (US); Ronald J. Crook, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 1385 days.

(21) Appl. No.: 11/090,496

(22) Filed: Mar. 25, 2005

(65) Prior Publication Data

US 2006/0213662 A1 Sep. 28, 2006

(51) Int. Cl.
*E21B 33/13* (2006.01)

(52) U.S. Cl. ..... 166/286; 166/293; 166/295

(58) Field of Classification Search ..... None
See application file for complete search history.

(56) References Cited

U.S. PATENT DOCUMENTS

| | | | | |
|---|---|---|---|---|
| 2,649,160 | A | 8/1953 | Williams et al. | 166/22 |
| 2,848,051 | A | 8/1958 | Williams | 166/28 |
| 2,890,752 | A | 6/1959 | Crone et al. | 166/22 |
| 3,132,693 | A | 5/1964 | Weisend | 166/33 |
| 3,202,214 | A | 8/1965 | McLaughlin, Jr. | 166/30 |
| 3,215,634 | A | 11/1965 | Walker | |
| 3,247,171 | A | 4/1966 | Walker et al. | |
| 3,284,393 | A | 11/1966 | Vanderhoff | |
| 3,302,717 | A | 2/1967 | West et al. | 166/33 |
| 3,306,870 | A | 2/1967 | Eilers et al. | |
| 3,375,872 | A | 4/1968 | McLaughlin, Jr. | 166/29 |
| 3,376,926 | A | 4/1968 | McLaughlin, Jr. | 166/29 |
| 3,447,608 | A | 6/1969 | Fry et al. | |
| 3,448,800 | A | 6/1969 | Parker et al. | |
| 3,464,494 | A | 9/1969 | McLaughlin | 166/292 |
| 3,493,529 | A | 2/1970 | Krottinger et al. | |
| 3,556,221 | A | 1/1971 | Haws et al. | 166/305 |
| 3,721,295 | A | 3/1973 | Bott | |
| 3,724,547 | A | 4/1973 | Bott | |
| 3,818,998 | A | 6/1974 | Hessert | 175/72 |
| 3,893,510 | A | 7/1975 | Elphingstone et al. | |
| 3,918,523 | A | 11/1975 | Stuber | 166/285 |
| 3,953,336 | A | 4/1976 | Daigle | 252/8.5 A |
| 3,959,003 | A | 5/1976 | Ostroot et al. | 106/93 |
| 4,034,809 | A | 7/1977 | Phillips et al. | |
| 4,069,062 | A | 1/1978 | Bürge | |
| 4,083,407 | A | 4/1978 | Griffin, Jr. et al. | 166/291 |
| 4,120,361 | A | 10/1978 | Threlkeld et al. | 166/294 |
| 4,172,066 | A | 10/1979 | Zweigle et al. | 260/29.6 TA |
| 4,182,417 | A | 1/1980 | McDonald et al. | |
| 4,191,254 | A * | 3/1980 | Baughman et al. | 166/286 |
| 4,202,413 | A | 5/1980 | Messenger | 166/292 |
| 4,205,611 | A * | 6/1980 | Slawinski | 102/324 |
| 4,232,741 | A | 11/1980 | Richardson et al. | |
| 4,235,291 | A | 11/1980 | Messenger | 166/292 |
| 4,248,304 | A | 2/1981 | Phillips | |
| 4,276,935 | A | 7/1981 | Hessert et al. | |
| 4,282,928 | A | 8/1981 | McDonald et al. | 166/274 |
| 4,299,710 | A | 11/1981 | Dupre et al. | 252/8.5 A |
| 4,304,298 | A | 12/1981 | Sutton | 166/293 |
| 4,340,427 | A | 7/1982 | Sutton | 106/87 |
| 4,367,093 | A | 1/1983 | Burkhalter et al. | 106/87 |
| 4,391,925 | A | 7/1983 | Mintz et al. | |
| 4,450,010 | A | 5/1984 | Burkhalter et al. | 106/87 |
| 4,463,808 | A * | 8/1984 | Mason et al. | 166/292 |
| 4,466,831 | A | 8/1984 | Murphey | 106/74 |
| 4,478,640 | A | 10/1984 | Holland | 106/76 |
| 4,487,864 | A | 12/1984 | Bermudez et al. | 524/2 |
| 4,507,154 | A | 3/1985 | Burge et al. | 106/315 |
| 4,515,216 | A | 5/1985 | Childs et al. | 166/293 |
| 4,565,578 | A | 1/1986 | Sutton et al. | 106/87 |
| 4,572,295 | A | 2/1986 | Walley | 166/295 |
| 4,579,668 | A | 4/1986 | Messenger | 252/8.5 LC |
| 4,588,031 | A | 5/1986 | Oliver, Jr. et al. | 166/291 |
| 4,635,726 | A | 1/1987 | Walker | |
| 4,646,834 | A | 3/1987 | Bannister | 166/291 |

(Continued)

FOREIGN PATENT DOCUMENTS

CN 1999 9 2/1999

(Continued)

OTHER PUBLICATIONS

Halliburton brochure entitled "Super CBL Additive Cement Additive" dated 1999.

(Continued)

*Primary Examiner*—Zakiya W. Bates
(74) *Attorney, Agent, or Firm*—Craig W. Roddy; Conley Rose, P.C.

(57) ABSTRACT

A package and methods for treating a wellbore using the same. In one embodiment, the method comprises servicing a wellbore in contact with a subterranean formation by placing a material in the wellbore, wherein the material is disposed within a closed container. The material is suitable for use in a wellbore and is capable of plugging a flow pathway. The method further comprises releasing the material from the container. In an embodiment, the material is a swelling agent, which may plug a permeable zone.

41 Claims, 1 Drawing Sheet

U.S. PATENT DOCUMENTS

| | | | | |
|---|---|---|---|---|
| 4,664,816 | A | 5/1987 | Walker | 252/8.512 |
| 4,670,501 | A | 6/1987 | Dymond et al. | |
| 4,690,996 | A | 9/1987 | Shih et al. | |
| 4,704,213 | A | 11/1987 | Delhommer et al. | 252/8.512 |
| 4,706,755 | A | 11/1987 | Roark et al. | |
| 4,724,906 | A | 2/1988 | Sydansk | 166/295 |
| 4,730,674 | A | 3/1988 | Burdge et al. | 166/295 |
| 4,777,200 | A | 10/1988 | Dymond et al. | |
| 4,818,288 | A | 4/1989 | Aignesberger et al. | 106/90 |
| 4,836,940 | A | 6/1989 | Alexander | |
| 4,886,550 | A | 12/1989 | Alexander | 106/74 |
| 4,896,724 | A | 1/1990 | Hazlett et al. | |
| 4,899,819 | A | 2/1990 | Hazlett et al. | |
| 4,941,533 | A | 7/1990 | Buller et al. | 166/252 |
| 4,961,760 | A | 10/1990 | Caskey et al. | 35/158 |
| 4,961,790 | A | 10/1990 | Smith et al. | 106/823 |
| 4,964,918 | A | 10/1990 | Brown et al. | |
| 4,989,673 | A | 2/1991 | Sydansk | |
| 5,002,127 | A | 3/1991 | Dalrymple et al. | 166/295 |
| 5,034,139 | A | 7/1991 | Reid et al. | |
| 5,078,212 | A * | 1/1992 | Boyle et al. | 166/278 |
| 5,086,841 | A | 2/1992 | Reid et al. | |
| 5,089,538 | A * | 2/1992 | Iizuka et al. | 523/132 |
| 5,106,516 | A | 4/1992 | Mueller et al. | |
| 5,120,367 | A | 6/1992 | Smith et al. | 106/823 |
| 5,145,012 | A | 9/1992 | Hutchins et al. | |
| 5,232,910 | A | 8/1993 | Mueller et al. | |
| 5,252,554 | A | 10/1993 | Mueller et al. | |
| 5,318,954 | A | 6/1994 | Mueller et al. | |
| 5,346,012 | A | 9/1994 | Heathman et al. | |
| 5,351,759 | A | 10/1994 | Nahm et al. | 166/293 |
| 5,385,206 | A | 1/1995 | Thomas | 166/269 |
| 5,421,410 | A | 6/1995 | Irani | |
| 5,439,057 | A | 8/1995 | Weaver et al. | 166/295 |
| 5,447,197 | A | 9/1995 | Rae et al. | 166/293 |
| 5,465,792 | A | 11/1995 | Dawson et al. | |
| 5,476,142 | A | 12/1995 | Kajita | 166/294 |
| 5,512,096 | A | 4/1996 | Krause | 106/718 |
| 5,547,506 | A | 8/1996 | Rae et al. | 106/730 |
| 5,550,189 | A | 8/1996 | Qin et al. | 525/54.3 |
| 5,588,488 | A | 12/1996 | Vijn et al. | |
| 5,591,701 | A | 1/1997 | Thomas | 507/240 |
| 5,707,443 | A | 1/1998 | Brown et al. | 106/713 |
| 5,718,292 | A | 2/1998 | Heathman et al. | 166/387 |
| 5,735,349 | A | 4/1998 | Dawson et al. | 166/295 |
| RE36,066 | E | 1/1999 | Mueller et al. | |
| 5,881,826 | A | 3/1999 | Brookey | |
| 5,913,364 | A | 6/1999 | Sweatman | 166/281 |
| 5,921,319 | A | 7/1999 | Curtice et al. | 166/279 |
| 6,060,434 | A | 5/2000 | Sweatman et al. | 507/216 |
| 6,123,159 | A | 9/2000 | Brookey et al. | |
| 6,148,917 | A | 11/2000 | Brookey et al. | |
| 6,156,708 | A | 12/2000 | Brookey et al. | |
| 6,167,967 | B1 | 1/2001 | Sweatman | 166/281 |
| 6,169,058 | B1 | 1/2001 | Le et al. | |
| 6,187,839 | B1 | 2/2001 | Eoff et al. | |
| 6,218,343 | B1 | 4/2001 | Burts, Jr. | 507/225 |
| 6,258,757 | B1 | 7/2001 | Sweatman et al. | 507/219 |
| 6,390,208 | B1 | 5/2002 | Brookey | |
| 6,405,801 | B1 | 6/2002 | Vijn et al. | 166/293 |
| 6,431,282 | B1 * | 8/2002 | Bosma et al. | 166/288 |
| 6,457,523 | B1 | 10/2002 | Vijn et al. | 166/293 |
| 6,460,632 | B1 | 10/2002 | Chatterji et al. | 175/66 |
| 6,465,397 | B1 | 10/2002 | Patterson | 507/222 |
| 6,508,306 | B1 | 1/2003 | Reddy et al. | 166/295 |
| 6,516,881 | B2 | 2/2003 | Hailey, Jr. | 166/278 |
| 6,516,882 | B2 | 2/2003 | McGregor et al. | 166/278 |
| 6,518,224 | B2 | 2/2003 | Wood | |
| 6,554,081 | B1 * | 4/2003 | Brooks et al. | 175/4.54 |
| 6,561,269 | B1 * | 5/2003 | Brown et al. | 166/77.1 |
| 6,581,701 | B2 | 6/2003 | Heying | 175/75 |
| 6,610,140 | B2 | 8/2003 | Vijn et al. | 106/738 |
| 6,616,753 | B2 | 9/2003 | Reddy et al. | 106/718 |
| 6,626,992 | B2 | 9/2003 | Vijn et al. | 106/726 |
| 6,631,766 | B2 | 10/2003 | Brothers et al. | 166/293 |
| 6,655,475 | B1 | 12/2003 | Wald | 175/64 |
| 6,702,044 | B2 | 3/2004 | Reddy et al. | 175/64 |
| 6,708,760 | B1 | 3/2004 | Chatterji et al. | 166/294 |
| 6,715,553 | B2 | 4/2004 | Reddy et al. | 166/309 |
| 6,716,797 | B2 | 4/2004 | Brookey | |
| 6,722,433 | B2 | 4/2004 | Brothers et al. | 166/288 |
| 6,722,434 | B2 | 4/2004 | Reddy et al. | 166/292 |
| 6,730,636 | B2 | 5/2004 | Vijn et al. | 507/114 |
| 6,767,867 | B2 | 7/2004 | Chatterji et al. | 507/216 |
| 6,770,601 | B1 | 8/2004 | Brookey | |
| 6,777,377 | B2 | 8/2004 | Myers et al. | 507/120 |
| 6,800,593 | B2 | 10/2004 | Dobson, Jr. et al. | 507/110 |
| 6,858,566 | B1 | 2/2005 | Reddy et al. | |
| 6,887,832 | B2 | 5/2005 | Kirsner et al. | |
| 7,156,174 | B2 | 1/2007 | Roddy et al. | |
| 7,204,312 | B2 | 4/2007 | Roddy et al. | |
| 7,316,275 | B2 | 1/2008 | Wang et al. | |
| 2001/0018975 | A1 | 9/2001 | Richardson et al. | 166/305.1 |
| 2002/0040812 | A1 | 4/2002 | Heying | |
| 2002/0170717 | A1 | 11/2002 | Venning et al. | 166/369 |
| 2002/0188040 | A1 | 12/2002 | Chen et al. | 524/35 |
| 2003/0008779 | A1 | 1/2003 | Chen et al. | 507/200 |
| 2003/0062170 | A1 | 4/2003 | Slack | 166/377 |
| 2003/0066651 | A1 | 4/2003 | Johnson | 166/369 |
| 2003/0075315 | A1 | 4/2003 | Nguyen et al. | 166/51 |
| 2003/0092582 | A1 | 5/2003 | Reddy et al. | |
| 2003/0144153 | A1 | 7/2003 | Kirsner et al. | |
| 2003/0181338 | A1 | 9/2003 | Sweatman et al. | 507/100 |
| 2003/0186819 | A1 | 10/2003 | Shaarpour | |
| 2003/0201103 | A1 | 10/2003 | Brookey et al. | |
| 2004/0069537 | A1 | 4/2004 | Reddy et al. | 175/72 |
| 2004/0069538 | A1 | 4/2004 | Reddy et al. | 175/72 |
| 2004/0108141 | A1 | 6/2004 | Reddy et al. | 175/65 |
| 2004/0168798 | A1 | 9/2004 | Creel et al. | 166/270 |
| 2004/0168801 | A1 | 9/2004 | Reddy et al. | 166/292 |
| 2004/0168802 | A1 | 9/2004 | Creel et al. | 166/293 |
| 2004/0168804 | A1 | 9/2004 | Reddy et al. | 166/295 |
| 2004/0168830 | A1 | 9/2004 | Reddy et al. | 175/65 |
| 2004/0171499 | A1 | 9/2004 | Ravi et al. | |
| 2004/0180794 | A1 | 9/2004 | Reddy et al. | |
| 2004/0221990 | A1 | 11/2004 | Heathman et al. | |
| 2004/0221991 | A1 | 11/2004 | Heathman et al. | |
| 2005/0009710 | A1 | 1/2005 | Heath | |
| 2005/0032652 | A1 | 2/2005 | Kirsner et al. | |
| 2005/0051363 | A1 | 3/2005 | Munoz, Jr. et al. | |
| 2005/0061505 | A1 | 3/2005 | Caveny et al. | |
| 2005/0098317 | A1 | 5/2005 | Reddy et al. | |
| 2005/0113260 | A1 | 5/2005 | Wood | |
| 2005/0113262 | A1 | 5/2005 | Ravi et al. | |
| 2005/0124502 | A1 | 6/2005 | Shaarpour | |
| 2005/0199401 | A1 * | 9/2005 | Patel et al. | 166/387 |
| 2006/0211580 | A1 | 9/2006 | Wang et al. | |
| 2007/0012447 | A1 | 1/2007 | Fang et al. | |

FOREIGN PATENT DOCUMENTS

| | | | |
|---|---|---|---|
| CN | 1348932 | | 5/2002 |
| CN | 1364739 | | 8/2002 |
| CN | 2003 6 | | 6/2003 |
| DE | 217796 | | 1/1985 |
| DE | 100 37 118 | A1 | 2/2002 |
| EP | 0530768 | A1 | 9/1992 |
| EP | 0 401 936 | B1 | 10/1994 |
| EP | 0 566 118 | B2 | 10/2001 |
| EP | 1 188 726 | A | 3/2002 |
| EP | 1 316 540 | A2 | 6/2003 |
| GB | 2271350 | A | 4/1994 |
| GB | 2325949 | A | 12/1998 |
| GB | 2 371 319 | A | 7/2002 |

| | | | | |
|---|---|---|---|---|
| JP | 53062308 | A | | 6/1978 |
| JP | 60235863 | | | 11/1985 |
| JP | 559886 | A | | 3/1993 |
| JP | 10088508 | A | | 9/1996 |
| JP | 2000272943 | A | | 3/1999 |
| JP | 2001048627 | A | | 2/2001 |
| JP | 2001146457 | A | * | 5/2001 |
| RU | 2 177 539 | | | 10/1999 |
| RU | 2160822 | C2 | | 12/2000 |
| SU | 953187 | A | | 8/1982 |
| SU | 1723312 | | | 3/1992 |
| WO | WO 84/01943 | | | 5/1984 |
| WO | 9916723 | A1 | | 4/1999 |
| WO | 0174967 | A1 | | 10/2001 |
| WO | WO 02/084070 | A1 | | 10/2002 |
| WO | WO 2004/101463 | A2 | | 11/2004 |
| WO | WO 2004/101463 | A3 | | 11/2004 |
| WO | WO 2004/101951 | A1 | | 11/2004 |
| WO | WO 2004/101952 | A1 | | 11/2004 |

OTHER PUBLICATIONS

Halliburton brochure entitled "MicroBond Expanding Additive for Cement" dated 1999.
Halliburton brochure entitled "FlexPlug® W Lost-Circulation Material" dated 2004.
Halliburton brochure entitled "FlexPlug® Service" dated 2004.
Halliburton brochure entitled "FlexPlug® OBM Lost-Circulation Material" dated 2004.
Halliburton brochure entitled "CFR-3™ Cement Friction Reducer Dispersant" dated 2004.
Halliburton brochure entitled "Flo-Chek® A Additive" dated 1999.
Halliburton brochure entitled "HydroChek Service—MOC/One Slurry for Selective Water Control".
Baroid brochure entitled "Diamond Seal™ Absorbent Polymer for Lost Circulation" dated 1998.
Baroid brochure entitled "Hydro=Plug™ Lost Circulation Plug" dated 2002.
Paper entitled "Inflow Analysis and Optimization of Slotted Liners" by T.M.V. Kaiser et al., dated 2002.
Halliburton brochure entitled "FlexPlug Service Stop Lost Circulation, Hold Your Bottom Line" dated 1998.
Halliburton brochure entitled "Accolade™ Drilling Fluid Exceeds New GOM Environmental Standards and Boosts Performance" dated 2002.
Baroid Fluid Services brochure entitled "ADAPTA™ HPHT Filtration Reducer" dated 2005.
Baroid Fluid Services brochure entitled "AQUAGEL® Viscosifier" dated 2005.
Baroid Fluid Services brochure entitled "BARACARB® Bridging Agent" dated 2005.
Baroid Fluid Services brochure entitled "BARAZAN® D Viscosifier/Suspension Agent" dated 2005.
Baroid Fluid Services brochuee entitled "BARAZAN® D Plus Viscosifier/Suspension Agent" dated 2005.
Baroid Fluid Services brochure entitled "CARBONOX® Filtration Control Agent" dated 2005.
Baroid Fluid Services brochure entitled "CLAY GRABBER® Flocculant" dated 2005.
Baroid Fluid Services brochure entitled "CLAYSEAL® Shale Stabilizer" dated 2005.
Baroid Fluid Services brochure entitled "CLAY SYNC™ Shale Stabilizer" dated 2005.
Baroid Fluid Services brochure entitled "COLDTROL® Thinner" dated 2005.
Baroid Fluid Services brochure entitled "DURATONE® E Filtration Control Agent" dated 2005.
Baroid Fluid Services brochure entitled "DURATONE® HT Filtration Control Agent" dated 2005.
Baroid Fluid Services brochure entitled "EZ MUL® NT Emulsifier" dated 2005.
Baroid Fluid Services brochure entitled "FILTER-CHEK®™ Filtration Control Agent" dated 2005.
Baroid Fluid Services brochuee entitled "GELTONE® Viscosifier" dated 2005.
Baroid Fluid Services brochure entitled "GELTONE® II Viscosifier" dated 2005.
Baroid Fluid Services brochure entitled "GELTONE® IV Viscosifier" dated 2005.
Baroid Fluid Services brochure entitled "GELTONE® V Viscosifier" dated 2005.
Baroid Fluid Services brochure entitled "GEM™ 2000 Shale Stabilizer" dated 2005.
Baroid Fluid Services brochure entitled "GEM™ CP Shale Stabilizer" dated 2005.
Baroid Fluid Services brochure entitled "GEM™ Shale Stabilizer" dated 2005.
Baroid Fluid Services brochure entitled "QUIK-THIN® Thinner" dated 2005.
Baroid Fluid Services brochure entitled "RHEMOD™ L Viscosifier/Suspension Agent" dated 2005.
Baroid Fluid Services brochure entitled "STEELSEAL® Lost Circulation Material" dated 2005.
Baroid Fluid Services brochuee entitled "SUSPENTINE™ Suspension Agent" dated 2005.
Baroid Fluid Services brochure entitled "LE™ SUPERMUL Emulsifier" dated 2005.
Smith, Richard et al., "Coordinated Optimization, new well design reduce wellbore stability problems in Valhall field" Oil & Gas Journal, 2004.
"Halliburton's solution to highly reactive clay formation challenges," technology Hydro-Guard, 2003.
"Halliburton's solution to higly reactive clay formation challenges" PetroMin, 2002.
Baroid Fluid Services brochure entitled "GEM(TM) GP Shale Stabilizer," Apr. 2005, 2 pages, Halliburton.
Derwent Abstract No. 1983-704150, abstract of Soviet Union Patent Publication No. SU 953187 published on Aug. 23, 1982.
Derwent Abstract No. 1992-072444, abstract of South Africa Patent Publication No. ZA 9100876A published on Dec. 24, 1991.
Derwent Abstract No. 2001-180538, abstract of Russian Patent Publication No. 2160822 C2 published on Dec. 20, 2000.
Derwent Abstract No. 1998-519099, abstract of Russian Patent Publication No. 2107158 C1 published on Mar. 20, 1998.
Derwent Abstract No. 2002-525993, abstract of Russian Patent Publication No. 2183264 C2 published on Jun. 10, 2002.
Foreign Communication from a related counterpart application—International Search Report, PCT/GB 03/05537, Apr. 16, 2004, 6 pages.
Foreign Communication from a related counterpart application—International Search Report and Written Opinion, PCT/GB2004/000671, Jul. 12, 2004, 6 pages.
Foreign Communication from a related counterpart application—International Search Report and Written Opinion, PCT/GB2004/001646, Jul. 27, 2004, 7 pages.
Foreign Communication from a related counterpart application—International Search Report and Written Opinion, PCT/GB2006/002659, Oct. 12, 2006, 11 pages.
Foreign Communication from a related counterpart application—International Search Report and Opinion, PCT/GB2004/000411, Jun. 16, 2004, 6 pages.
Translation of Russian Patent Publication No. RU 2107158 C1 published on Mar. 20, 1998.
Translation of Russian Patent Publication No. RU 2160822 C2 published on Dec. 20, 2000.
Translation of Russian Patent Publication No. RU 2183264 C2 published on Jun. 10, 2002.
Advisory Action dated Jun. 6, 2008 (3 pages), U.S. Appl. No. 10/967,121, filed Oct. 18, 2004.
Advisory Action dated Apr. 15, 2009 (3 pages), U.S. Appl. No. 10/967,121, filed Oct. 18, 2004.
Derwent Abstract No. 2001-180538, abstract of Russian Patent Publication No. 2160822 C2, 2009, 2 pages, Derwent Information Ltd.
Office Action (Final) dated Feb. 4, 2009 (20 pages), U.S. Appl. No. 10/967,121, filed Oct. 18, 2004.

Office Action dated Apr. 10, 2009 (14 pages), U.S. Appl. No. 11/180,767, filed Jul. 13, 2005.
Office Action dated Apr. 15, 2009 (12 pages), U.S. Appl. No. 10/970,444, filed Oct. 21, 2004.
Office Action dated Jul. 16, 2009 (19 pages), U.S. Appl. No. 10/375,183, filed Feb. 27, 2003.
Office Action dated Jul. 21, 2009 (18 pages), U.S. Appl. No. 10/967,121, filed Oct. 18, 2004.
Foreign communication from a related counterpart application—International Search Report and Written Opinion, PCT/EP2004/005479, Sep. 30, 2004, 8 pages.
Foreign communication from a related counterpart application—International Preliminary Report on Patentability, PCT/EP2004/005479, Aug. 30, 2005, 7 pages.

* cited by examiner

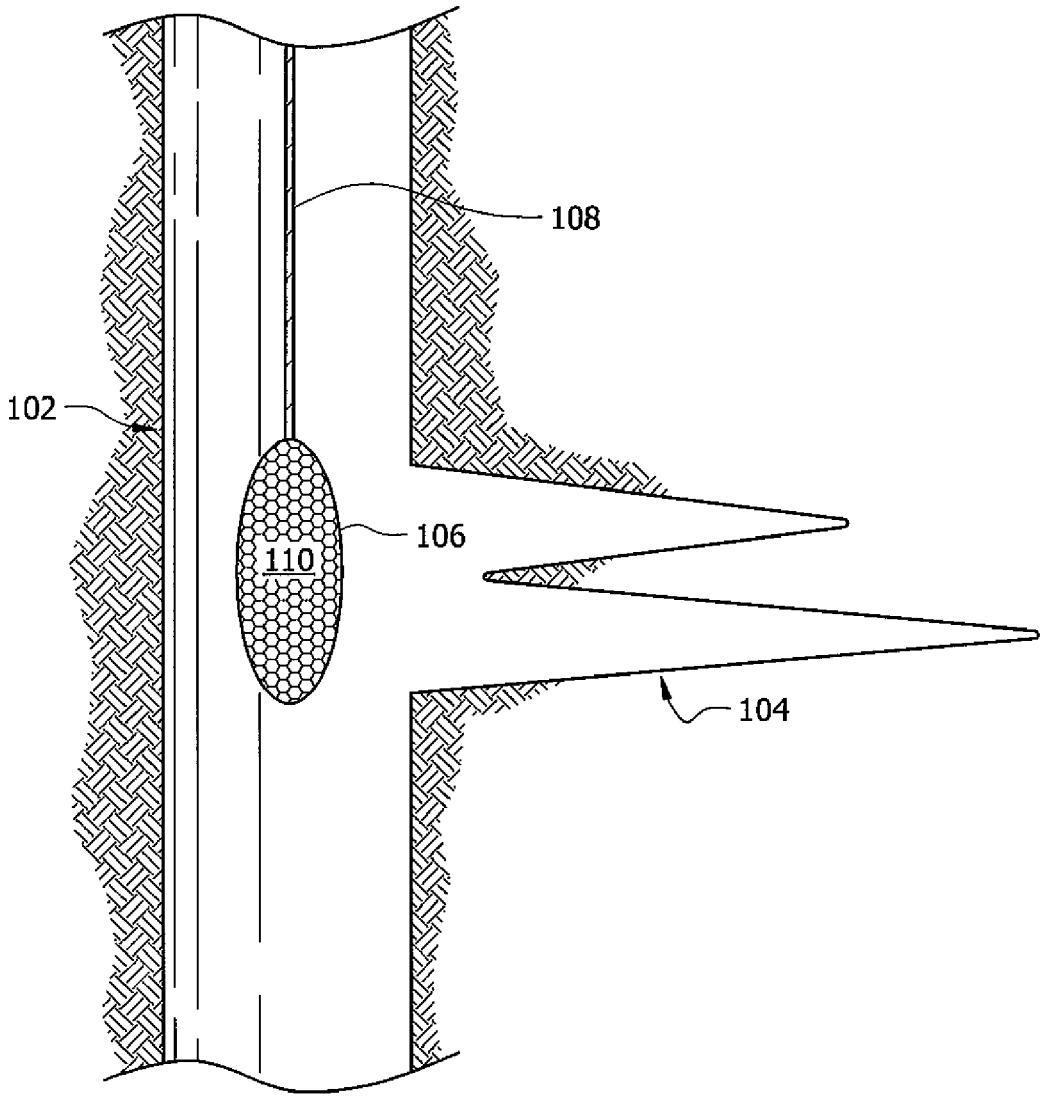
108
102
106
110
104

METHODS OF DELIVERING MATERIAL DOWNHOLE

CROSS-REFERENCE TO RELATED APPLICATIONS

Related co-pending applications are U.S. patent application Ser. No. 10/375,183 filed Feb. 27, 2003, entitled "Compositions and Methods of Cementing in Subterranean Formations Using a Swelling Agent to Inhibit the Influx of Water into a Cement Slurry;" U.S. patent application Ser. No. 10/375,205 filed Feb. 27, 2003, entitled "Methods for Passing a Swelling Agent into a Reservoir to Block Undesirable Flow Paths During Oil Production;" U.S. patent application Ser. No. 10/375,206 filed Feb. 27, 2003, entitled "A Method of Using a Swelling Agent to Prevent a Cement Slurry from being Lost to a Subterranean Formation;" U.S. patent application Ser. No. 10/967,121 filed Oct. 15, 2004, entitled "Methods of Generating a Gas in a Plugging Composition to Improve its Sealing Ability in a Downhole Permeable Zone;" and U.S. patent application Ser. No. 10/970,444 filed Oct. 20, 2004, entitled "Methods of Using a Swelling Agent in a Wellbore," each of which is incorporated by reference herein in its entirety.

BACKGROUND OF THE INVENTION

1. Field of the Invention

This invention relates to the field of cementing operations and more specifically to the field of using swelling agents to service a wellbore.

2. Background of the Invention

A natural resource such as oil or gas residing in a subterranean formation can be recovered by drilling a well into the formation. The subterranean formation is usually isolated from other formations using a technique known as well cementing. In particular, a wellbore is typically drilled down to the subterranean formation while circulating a drilling fluid through the wellbore. After the drilling is terminated, a string of pipe, e.g., casing, is run in the wellbore. Primary cementing is then usually performed whereby a cement slurry is pumped down through the string of pipe and into the annulus between the string of pipe and the walls of the wellbore to allow the cement slurry to set into an impermeable cement column and thereby seal the annulus. Secondary cementing operations may also be performed after the primary cementing operation. One example of a secondary cementing operation is squeeze cementing whereby a cement slurry is forced under pressure to areas of lost integrity in the annulus to seal off those areas.

One problem commonly encountered during primary cementing is the presence of one or more permeable zones in the subterranean formation. Such permeable zones result in the loss of at least a portion of the cement slurry to the subterranean formation as the slurry is being pumped down through the casing and up through the annulus. Due to such loss, an insufficient amount of the slurry passes above the permeable zones to fill the annulus from top to bottom. Further, dehydration of the cement slurry may occur, compromising the strength of the cement that forms in the annulus. The permeable zones may be, for example, depleted zones, zones of relatively low pressure, lost circulation zones having naturally occurring fractures, weak zones having fracture gradients exceeded by the hydrostatic pressure of the cement slurry, or combinations thereof. In some cases, the weak zones may contain pre-existing fractures that expand under the hydrostatic pressure of the cement slurry.

Various methods and chemicals have been used in attempts to prevent such problems. For instance, swelling agents have been used to plug such permeable zones by blocking undesirable flow pathways. Such swelling agents typically absorb water and expand to form a mass that plugs the flow pathway. The swelling agents are typically placed downhole at the permeable zone by mixing with a carrier fluid. Drawbacks to such techniques include limitations on the concentration of the swelling agent in the carrier fluid, which typically requires a large quantity of carrier fluid. In addition, pumping large quantities of carrier fluid is typically time consuming. Further drawbacks include premature swelling of the swelling agent, for instance by exposure to water before reaching the intended location in the wellbore.

Consequently, there is a need for more efficient methods of preventing lost circulation. Further needs include a more efficient method of delivering swelling agents downhole. Additional needs include improved methods for plugging permeable zones.

BRIEF SUMMARY OF SOME OF THE PREFERRED EMBODIMENTS

These and other needs in the art are addressed in one embodiment by a method of servicing a wellbore in contact with a subterranean formation. The method comprises placing a material in the wellbore, wherein the material is disposed within a closed container. The material is suitable for use in a wellbore and is capable of plugging a flow pathway. The method further comprises releasing the material from the container. The material may comprise a swelling agent. In some embodiments, a sealing agent and/or a weighting material may also be enclosed with the material.

In an additional embodiment, needs in the art are addressed by a package for plugging a flow pathway in a wellbore. The package comprises a swelling agent disposed within a closed container.

By placing the material in the wellbore within a container, problems in the art such as the material reacting with reactive mediums in an unintended location in the wellbore or at an unintended time are overcome. For instance, in embodiments wherein the material is a swelling agent, the container may provide dry transport of the swelling agent to a lost circulation zone, which mitigates the chance of the swelling agents contacting a reactive medium such as water prior to being placed in the zone of interest.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE FIGURE

The FIGURE is a side section view of an embodiment of an apparatus suitable for implementing the downhole delivery method.

DETAILED DESCRIPTION OF THE PREFERRED EMBODIMENTS

In an embodiment, a material is disposed within a container and placed in a wellbore that penetrates a subterranean formation. Disposing the material within the container provides a package for transport of the material in the wellbore. In embodiments wherein the material is closed within the container, the material is placed in the wellbore by dry transport. Dry transport refers to transporting the material without its exposure to a reactive medium such as water. By providing dry transport of the material to a desired destination in the wellbore, the material may not react with a reactive medium until at the desired location. The material can be any material suitable for use in a wellbore and that is capable of plugging a flow pathway such as in a permeable zone of the wellbore. In an embodiment, the material comprises a swelling agent. Further embodiments include methods for introducing the container with the enclosed material into the wellbore. It is to be understood that "subterranean formation" encompasses both areas below exposed earth and areas below earth covered by water such as ocean or fresh water.

The package comprising the container and material allows a high concentration of the material (e.g., swelling agent) to be placed in a location of interest, for instance a permeable zone. The package can be used for any purpose. For instance, the package can be used to service the wellbore. Without limitation, servicing the wellbore includes positioning the swelling agent in the wellbore to isolate the subterranean formation from a portion of the wellbore; to support a conduit in the wellbore; to plug a perforation set, which may be placed for the initial injection of the wellbore, for the production of the well, or as an access to gain entry to a problem interval behind the casing; to plug a void or crack in the conduit; to plug a void or crack in a cement sheath disposed in an annulus of the wellbore; to plug an opening between the cement sheath and the conduit; to prevent the loss of aqueous or non-aqueous drilling fluids into lost circulation zones such as a void, vugular zone, or fracture; to be used as a fluid in front of cement slurry in cementing operations; and to seal an annulus between the wellbore and an expandable pipe or pipe string.

In an embodiment, a package comprising a swelling agent disposed in a container is placed in a wellbore. A swelling agent refers to a material that is capable of absorbing water and swelling, i.e., increases in size as it absorbs the water. In an embodiment, the swelling agent forms a gel mass upon swelling that is effective for blocking a flow pathway of a fluid. In some embodiments, the gel mass has a relatively low permeability to fluids used to service a wellbore such as a drilling fluid, a fracturing fluid, a sealant composition (e.g., cement), an acidizing fluid, an injectant, etc., thus creating a barrier to the flow of such fluids. A gel refers to a crosslinked polymer network swollen in a liquid. The crosslinker may be part of the polymer and thus may not leach out of the gel. Without limitation, examples of suitable swelling agents include superabsorbers, absorbent fibers, wood pulp, silicates, coagulating agents, carboxymethyl cellulose, hydroxyethyl cellulose, synthetic polymers, or combinations thereof.

In an embodiment, the swelling agent comprises superabsorbers. Superabsorbers are commonly used in absorbent products such as horticulture products, wipe and spill control agents, wire and cable water-blocking agents, ice shipping packs, diapers, training pants, feminine care products, and a multitude of industrial uses. Superabsorbers are swellable, crosslinked polymers that, by forming a gel, have the ability to absorb and store many times their own weight of aqueous liquids. Superabsorbers retain the liquid that they absorb and typically do not release the absorbed liquid, even under pressure. Examples of superabsorbers include sodium acrylate-based polymers having three dimensional, network-like molecular structures. The polymer chains are formed by the reaction/joining of hundreds of thousands to millions of identical units of acrylic acid monomers, which have been substantially neutralized with sodium hydroxide (caustic soda). Crosslinking chemicals tie the chains together to form a three-dimensional network, which enable the superabsorbers to absorb water or water-based solutions into the spaces in the molecular network and thus form a gel that locks up the liquid. Additional examples of suitable superabsorbers include but are not limited to crosslinked polyacrylamide; crosslinked polyacrylate; crosslinked hydrolyzed polyacrylonitrile; salts of carboxyalkyl starch, for example, salts of carboxymethyl starch; salts of carboxyalkyl cellulose, for example, salts of carboxymethyl cellulose; salts of any crosslinked carboxyalkyl polysaccharide; crosslinked copolymers of acrylamide and acrylate monomers; starch grafted with acrylonitrile and acrylate monomers; crosslinked polymers of two or more of allylsulfonate, 2-acrylamido-2-methyl-1-propanesulfonic acid, 3-allyloxy-2-hydroxy-1-propane-sulfonic acid, acrylamride, and acrylic acid monomers; or combinations thereof. In one embodiment, the superabsorber absorbs not only many times its weight of water but also increases in volume upon absorption of water many times the volume of the dry material.

In an embodiment, the superabsorber is a dehydrated, crystalline (e.g., solid) polymer. In other embodiments, the crystalline polymer is a crosslinked polymer. In an alternative embodiment, the superabsorber is a crosslinked polyacrylamide in the form of a hard crystal. A suitable crosslinked polyacrylamide is the DIAMOND SEAL polymer available from Baroid Drilling Fluids, Inc., of Halliburton Energy Services, Inc. The DIAMOND SEAL polymer used to identify several available superabsorbents are available in grind sizes of 0.1 mm, 0.25 mm, 1 mm, 2 mm, 4 mm, and 14 mm. The DIAMOND SEAL polymer possesses certain qualities that make it a suitable superabsorber. For example, the DIAMOND SEAL polymer is water-insoluble and is resistant to deterioration by carbon dioxide, bacteria, and subterranean minerals. Further, the DIAMOND SEAL polymer can withstand temperatures up to at least 250° F. without experiencing breakdown and thus may be used in the majority of locations where oil reservoirs are found. An example of a biodegradable starch backbone grafted with acrylonitrile and acrylate is commercially available from Grain Processing Corporation of Muscantine, Iowa as WATER LOCK.

As mentioned previously, the superabsorber absorbs water and is thus physically attracted to water molecules. In the case where the swelling agent is a crystalline crosslinked polymer, the polymer chain solvates and surrounds the water molecules during water absorption. In effect, the polymer undergoes a change from that of a dehydrated crystal to that of a hydrated gel as it absorbs water. Once fully hydrated, the gel usually exhibits a high resistance to the migration of water due to its polymer chain entanglement and its relatively high viscosity. The gel can plug permeable zones and flow pathways because it can withstand substantial amounts of pressure without being dislodged or extruded.

In an embodiment, the superabsorber has a particle size (i.e., diameter) of greater than or equal to about 0.01 mm, alternatively greater than or equal to about 0.25 mm, alternatively less than or equal to about 14 mm, before it absorbs water (i.e., in its solid form). The larger particle size of the superabsorber allows it to be placed in permeable zones in the wellbore, which are typically greater than about 1 mm in diameter. As the superabsorber undergoes hydration, its physical size increases by about 10 to about 800 times its original weight. The resulting size of the superabsorber is thus of sufficient size to plug flow pathways in the formation and permeable zones in the wellbore so that fluids cannot undesirably migrate therethrough. It is to be understood that the amount and rate by which the superabsorber increases in size may vary depending upon temperature, grain size, and the ionic strength of the carrier fluid. The temperature of a well typically increases from top to bottom such that the rate of swelling increases as the superabsorber passes downhole. The rate of swelling also increases as the particle size of the superabsorber decreases and as the ionic strength of the carrier fluid, as controlled by salts such as sodium chloride or calcium chloride, decreases and vice versa.

The swell time of the superabsorber may be in a range of from less than about 5 minutes to about 16 hours, alternatively in a range of from about 1 hour to about 6 hours.

In some embodiments, the swelling agent is combined with a silicate solution comprising sodium silicate, potassium silicate, or both to form a composition for treating permeable zones in a subterranean formation. A gelling agent capable of causing the silicate solution to gel at the downhole temperature is also included in the composition. The composition is enclosed within the container and placed in the wellbore. The gelling agent effectively lowers the pH of the silicate solution at the downhole temperature, causing silica gel or particles to form within the swelling agent, as well as in the surrounding matrix fluid, thereby increasing the strength of the composition. Without being limited by theory, the gelling agent and silicate solution may also displace air or a void surrounding the swelling agent to increase the density of the swelling agent. Such an increase in density may provide the swelling agent with a density greater than that of the drilling fluids, which may facilitate placement of the container. The matrix silica gel also assists the swelling agent in plugging the permeable zones in the subterranean formation. Examples of silicate solutions containing gelling agents having suitable gel times at different temperatures are INJECTROL silicate formulations, which can be purchased from Halliburton Energy Services, Inc. Alternatively, the silicate solution containing the swelling agent, upon placement in a permeable zone and release from the container, may be brought into contact with an aqueous calcium salt solution (a gelling agent), e.g., calcium chloride solution, to form an insoluble calcium silicate barrier in the permeable zone.

According to some embodiments, a rapidly dissolvable powdered silicate comprising a mixture of sodium silicate and potassium silicate can be mixed with a fluid to form a silicate solution for incorporation in the swelling agent and enclosure in the container. The molar ratio of silicon dioxide to sodium oxide in the sodium silicate may be from about 1.5:1 to about 3.3:1, and the molar ratio of silicon dioxide to potassium oxide in the potassium silicate may be from about 1.5:1 to about 3.3:1. The powdered silicate may be partially hydrated to enable it to be dissolved rapidly. In an embodiment, it may have a water content of from about 14% to about 16% by weight of hydrated silicate.

Examples of gelling agents that may be used to activate or gel the silicate solutions include acids and chemicals that react in the presence of the silicate solution to lower the pH of the composition at wellbore temperatures. According to one embodiment, the gelling agents include, but are not limited to, sodium acid pyrophosphate, lactose, urea, and an ester or lactone capable of undergoing hydrolysis in the presence of the silicate solution. In yet another embodiment, the gelling agent is a mixture of a reducing agent and an oxidizing agent capable of undergoing an oxidation-reduction reaction in the presence of the silicate solution. Suitable silicate solutions and gelling agents (or activators) are also disclosed in U.S. Pat. Nos. 4,466,831; 3,202,214; 3,376,926; 3,375,872; and 3,464,494, each of which is incorporated by reference herein in its entirety.

Additional additives may also be combined with the material (e.g., swelling agent) and placed in the container. For example, sealing agents and/or weighting materials may be combined with the material and enclosed in the container. Without limitation, examples of suitable sealing agents include swelling clays, silicate salts with gelling agents, divalent metal salts, thermosetting resin compositions, latex emulsions, or combinations thereof. Weighting materials may be used to increase the density of the material in the container. In one embodiment, a sufficient amount of weighting material is disposed within the closed container to increase the rate at which the container passes down through the wellbore. Without being limited by theory, the increased density may increase the rate at which the container passes down through the fluid in the wellbore. Without limitation, examples of suitable weighting materials include barite, silica flour, zeolites, lead pellets, sand, fibers, polymeric material, or combinations thereof.

The container may be any receptacle that is suitable for use in a wellbore and suitable for transporting the material in the wellbore. In an embodiment, the container is capable of enclosing a material. For instance, the container may be closed with the material disposed inside the container. A closed container refers to the container substantially preventing direct exposure of the material therein from any fluids in the wellbore that may enter the container through an opening in the container. An opening in the container refers to an aperture or passage in the container whereby the material may be exposed to fluids. In alternative embodiments, the closed container is porous, semi-porous, osmotically permeable to wellbore fluids, osmotically semi-permeable to wellbore fluids, or impermeable to wellbore fluids and/or the enclosed material. A porous container refers to a container having at least one pore through which a fluid may pass. It is to be understood that a pore is smaller than an opening and has a diameter of less than about 500 microns. A semi-porous container refers to a container wherein a portion of the container is porous, and a portion of the container is non-porous. An osmotically permeable container refers to a container that allows a fluid (e.g., solvent) with dissolved constituents (e.g., solutes) to flow from a high concentration zone (e.g., outside the container) to a low concentration zone (e.g., inside the container) under fluid pressure until the fluid concentration is substantially similar on both sides of the container. An osmotically semi-permeable container refers to a container that allows a solvent to flow from a high concentration zone to a low concentration zone but restricts flow of a solute from the high concentration side to the low concentration side. For instance, an osmotically semi-permeable container allows water from the wellbore fluid to enter the container without allowing dissolved salts to enter. It is to be understood that in some embodiments a portion of the solute (e.g., salts) may flow from the high concentration zone to the low concentration zone. The water transport may stop when the concentrations (e.g., activities) of the solutions on both sides of the osmotically semi-permeable container are the same or when the hydraulic pressure inside the container equals the pressure of the wellbore fluids. In a wellbore, wherein the wellbore fluid exerts pressure on the container containing the dry material, the water entering the container may swell the material. The material may increase in volume and apply pressure on the container wall, which may be sufficient to rupture the wall and release the contents of the container into the wellbore. In alternative embodiments, the container may be sufficiently elastic to accommodate the expansion of the material.

In such porous, semi-porous, osmotically permeable, or osmotically semi-permeable containers, the inflow of water from the wellbore into the container may result in swelling of the solid material resulting in a pressure buildup that may result in a rupture of the container and release of the contents. It is to be understood that in some embodiments the material within the closed container may not be exposed to wellbore fluids through openings or pores. In an embodiment, the closed container is impermeable to the wellbore fluids and/or the enclosed material, whereby no or an insubstantial amount of wellbore fluid passes into the container and/or no or an insubstantial amount of enclosed material passes out of the container. An insubstantial amount is an amount that does not materially affect the desired performance of the system.

The container may comprise a polymer. Without limitation, examples of suitable polymers include polyethylene, polypropylene, polyvinylchloride (PVC), polyvinylidenechloride, ethylene-vinylacetate (EVA) copolymer, poly(ether or ketone), styrene-butadiene based latex, or combinations thereof. In an alternative embodiment, the polymer comprises a water soluble or water degradable polymer. The water soluble polymer may at least partially dissolve upon contact with fluid in the wellbore (e.g., water). By dissolving upon contact with fluid, the container may release the material (e.g., swelling agent) into the wellbore. Water degradable polymers may partially degrade upon exposure to aqueous fluids under downhole conditions and may result in the container losing at least a portion of its mechanical strength, which may allow for easier disintegration of the container and thereby release of its contents (e.g., the material). Without limitation, examples of suitable water soluble or water degradable polymers include polyvinyl alcohol, polyvinyl acetate, hydroxyethyl cellulose, carboxymethyl cellulose, sodium carboxymethyl hydroxyethyl cellulose, methyl hydroxy propyl cellulose, derivatives of polyethylene glycol, starches, cellulose triester, polyethylene oxide, polyesters such as polylactate, or combinations thereof. Examples of commercially available water soluble or water degradable containers include without limitation polyvinyl alcohol sachets available from Gowan Milling, LLC, Yuma, Ariz. and water soluble containers available from Greensol, Sens, France.

In some alternative embodiments, a timed release of the materials into the wellbore may be accomplished by controlling the dissolution rate of the container. The dissolution rate of the container may be controlled by providing a container with a thickness and composition that may dissolve at about a rate (e.g., a known or variable rate) upon exposure to expected downhole conditions. For instance, multiple layers of different materials can be co-extruded as a film such that a water insoluble layer may be sandwiched between two water soluble or water degradable layers. The water soluble or water degradable layer exposed to aqueous fluids under downhole conditions may disintegrate, which may expose a weaker layer that may be water insoluble. Such an exposed water insoluble layer may lose a portion of its mechanical strength under wellbore conditions. For instance, in the wellbore, the water insoluble layer may be exposed to wellbore temperatures at about or above its melting point temperature. Small punctures in this water insoluble layer may allow water to enter the container and break down the inner water soluble or water degradable layer that may result in further weakening of the container, which may lead to rupture and release of the contents. In alternative embodiments, the water insoluble layer may be the innermost layer on top of which the water soluble and/or water degradable layers are disposed. In other alternative embodiments, the container may be composed of components that may be less soluble in fluids at cooler temperatures than in fluids at warmer temperatures. Without limitation, examples of such materials include polyvinyl acetate. Without limitation, cooler temperatures may refer to temperatures from about 50° F. to about 150° F., and warmer temperatures may refer to temperatures from about 151° F. to about 450° F. For instance, completely hydrolyzed polyvinyl acetate may be significantly less soluble in cooler water than in warmer water. In other embodiments, containers may be designed in such a way to dissolve or melt only at downhole temperatures. For instance, ethylene copolymers with, for example, propylene, butene or 1-hexene may be designed to melt at temperatures from about 100° F. to about 250° F.

Osmotically permeable and osmotically semi-permeable containers may comprise any polymers that are suitable for use in a wellbore and that are osmotically permeable and osmotically semi-permeable, respectively. Without limitation, examples of osmotically permeable and semi-permeable materials include polymers such as pig membrane, cellulose acetate, cellulose triacetate, polyamide, polyamide/imide resins, polyether sulfones, polysulfones, polyphenyl sulfones, polyvinylidene fluoride, or combinations thereof. Without limitation, examples of commercially available sulfone, polyamide, and fluoride polymers include those available from Solvay Advanced Polymers of Alpharetta, Ga., USA as UDEL, RADEL, SOLEF, HYLAR, and TORLON. A commercial example of osmotically permeable material may be HYDROPACK, which is available from Hydrations Technologies, Albany, N.Y. In another alternative embodiment, the container comprises paper, cotton, wood, ceramic, glass, or combinations thereof.

The container may be rigid or substantially flexible. In an embodiment, the container is substantially flexible. Flexible refers to the container having the capability of being flexed or bent without substantial damage to the container. It is to be understood that the container may have a variety of shapes. In one embodiment, the container is a bag comprising a polymer. In an alternative embodiment, the container may be a rigid bag that can retain dimensional integrity, for example having a tube-like shape.

The container may have any size suitable for containing the material and being received in the wellbore. For instance, the container may have a thickness of from about 2 ply to about 10 ply, alternatively from about 2 ply to about 4 ply, and alternatively from about 6 ply to about 10 ply. In an alternative embodiment, the container has a suitable wall thickness calculated to provide sufficient strength for containment during transport into the well. The container may have any length suitable for placement in the wellbore. In an embodiment, the container has a diameter of less than about 2 inches and a length of from about 5 feet to about 40 feet.

In embodiments wherein the container is closed, the material may be enclosed within the container by closing any openings in the container. In an embodiment, the container is sufficiently closed to substantially prevent exposure of the material within the container to fluids in the wellbore. In another embodiment, the container is sealed against the wellbore environment. The container may be closed by any suitable method. For instance, the openings may be clipped, melted, plugged, and/or glued. Clipping includes using fasteners such as clips, staples, hooks and the like. Melting includes using heat, chemicals, or combinations thereof to seal an opening. For instance, sufficient heat can be applied to an appropriate area of the container to melt a portion of the container. Pressure (e.g., from a press) can be applied to the melted portion of the container to press the melted portions sufficiently together whereby the opening is sealed after it is cooled to below the melting point of the container.

In an embodiment and as shown in the FIGURE, the material 110 is placed in the container 106 and the container 106 is closed before the container 106 is placed in the wellbore 102. In alternative embodiments, the container 106 is partially closed. The container 106 may be placed in the wellbore 102 by any suitable method. For instance, the container 106 may be dropped in an empty wellbore 102, dropped through the drill string, lowered into the wellbore 102 by one or more tethers 108, or placed in the wellbore 102 by a dump bailer. Dropping the container 106 may include manual and/or mechanical displacement of the container 106 into the wellbore 102. It is to be understood that a tether 108 refers to a length of flexible material that is suitable for holding the container 106. Without limitation, examples of suitable tethers 108 include rope, chain, cord, cable, and the like. In an embodiment, the tether 108 is biodegradable. For example, the tether 108 may comprise an organic material such as hemp. In an embodiment, the tether 108 remains in the permeable zone 104 and serves as a plugging material 110. In one embodiment, a cutting tool cuts the tether 108, allowing it to remain in the wellbore 102. For instance, a cutting tool is lowered into the wellbore 102 to cut the tether, 108. The cutting tool may be any suitable device for cutting the tether 108. Without limitation, examples of cutting tools include a mechanical knife assembly or actuated cutting device. For instance, a mechanical knife assembly may be placed on the tether 108 and may cut the tether 108 by an upward cutting action provided by the assembly's tethering connection. The actuated cutting device may be a timed actuated cutting device run in the wellbore 102 in conjunction with the container 106. A dump bailer refers to a tool used to place slurry or other materials in a wellbore 102. Dump bailers may be constructed from cylindrical containers 106 with a diameter less than the wellbore 102 or drilled borehole and may have a length less than the draw-works of the operational workover rig. The dump bailer may be sealed top and bottom and may be constructed from suitable materials such as metals (e.g., steel, brass, or aluminum) and plastics. The release of sealed materials 110 placed in a dump bailer may be facilitated by devices such as breakable plates, electrical driven opening devices, firing mechanisms, physical manipulations, and the like. Without being limited by theory, a dump bailer may provide protection against premature damage to the container 106 during placement.

In some embodiments, once the container is placed in the wellbore, the pressure in the wellbore may force the container to a permeable zone. It is to be understood that the pressure in the wellbore may force the container to a point of lower pressure in the wellbore, which may be the permeable zone.

The material may be released from the closed container to the wellbore by any suitable method. For instance, the material may be released by dissolution of at least a portion of the container, puncturing the container, bursting the container under pressure in the wellbore, or combinations thereof. The container may be punctured by any suitable method. Without limitation, examples of methods for puncturing the container include using a cutting tool, a drill bit, a conduit in the wellbore, the structure of the formation once the container is placed against it during squeeze applications, or combinations thereof. For instance, after a desired number of containers are placed in an empty wellbore, a drill bit can be lowered into the wellbore to puncture the containers, thereby releasing the material into the wellbore. The released swelling agent may then begin to gel and expand. It is to be understood that placing containers in the wellbore and releasing the swelling agents may be repeated as desired, e.g., until the lost circulation is reduced.

In an embodiment, well completion operations such as primary and secondary cementing operations may include placing in the wellbore a package comprising a swelling agent disposed within a closed container. In primary cementing, a swelling agent is placed in a container, and the container is closed. The closed container with the enclosed swelling agent is placed in the wellbore. The swelling agent is released from the container and positioned at the location of interest. The swelling agent is allowed to set such that it isolates the subterranean formation from a different portion of the wellbore. The swelling agent thus forms a barrier that prevents fluids in that subterranean formation from migrating into other subterranean formations. Within the annulus, the swelling agent also serves to support a conduit, e.g., casing, in the wellbore. In one embodiment, the wellbore in which the swelling agent is positioned belongs to a multilateral wellbore configuration. It is to be understood that a multilateral wellbore configuration includes at least two principal wellbores connected by one or more ancillary wellbores. In secondary cementing (which is typically referred to as squeeze cementing), the swelling agent may be strategically positioned in the wellbore to plug permeable zones such as without limitation a void or crack in the conduit, a void or crack in the hardened sealant (e.g., cement sheath) residing in the annulus, a relatively small opening known as a microannulus between the cement sheath and the conduit, the cement sheath and the formation, and in the cement sheath structure itself.

In another embodiment, a package comprising a swelling agent disposed within a container may be introduced to the wellbore to prevent the loss of aqueous or non-aqueous drilling fluids into lost circulation zones such as voids, vugular zones, and natural or induced fractures while drilling. In such an embodiment, the swelling agent may be disposed within a closed container. To prevent the fluid loss, the package is placed in the wellbore, and pressure within the wellbore may force the package to the lost circulation zone at which the swelling agent is released from the container. The swelling agent reacts with wellbore fluids and provides a relatively viscous mass inside the lost circulation zone, which mitigates the flow of fluids to and from the lost circulation zone. The swelling agent may also form a non-flowing, intact mass inside the lost circulation zone. The mass plugs the zone and inhibits loss of subsequently pumped drilling fluid, which allows for further drilling.

While preferred embodiments of the invention have been shown and described, modifications thereof can be made by one skilled in the art without departing from the spirit and teachings of the invention. The embodiments described herein are exemplary only, and are not intended to be limiting.

Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of servicing a wellbore in contact with a subterranean formation, comprising: placing a closed container in the wellbore, wherein the closed container comprises a material effective to plugging a flow pathway in the wellbore; and releasing the material from the container, wherein the material comprises a swelling agent, wherein the swelling agent comprises a superabsorber, and wherein the superabsorber comprises a dehydrated, crystalline polymer.

2. The method of claim 1, wherein the material further comprises a silicate solution disposed within the container.

3. The method of claim 1, wherein the closed container provides for dry transport of the material in the wellbore.

4. The method of claim 1, further comprising a sealing agent, a weighting material, or combinations thereof disposed within the container.

5. The method of claim 1, wherein the container is porous, semi-porous, osmotically permeable, osmotically semi-permeable, or impermeable.

6. The method of claim 1, wherein the container comprises a polymer.

7. The method of claim 6, wherein the polymer comprises a polyethylene, a polypropylene, a polyvinylchloride, a polyvinylidenechloride, an ethylene-vinylacetate copolymer, a poly ether, a poly ketone, a styrene-butadiene based latex, or combinations thereof.

8. The method of claim 7, wherein releasing the material comprises dissolving at least a portion of the container.

9. The method of claim 6, wherein the polymer comprises a water soluble or water degradable polymer.

10. The method of claim 9, wherein the water soluble or water degradable polymer comprises a polyvinyl alcohol, a polyvinyl acetate, a hydroxyethyl cellulose, a carboxymethyl cellulose, a sodium carboxymethyl hydroxyethyl cellulose, a methyl hydroxy propyl cellulose, a derivative of polyethylene glycol, a starch, a cellulose triester, a polyethylene oxide, a polyester, or combinations thereof.

11. The method of claim 10, wherein releasing the material comprises dissolving at least a portion of the container and wherein the superabsorber's physical size increases by about 10 to about 800 times when released from the container.

12. The method of claim 1, wherein releasing the material comprises dissolving at least a portion of the container, puncturing the container, bursting the container with pressure in the wellbore, bursting the container by swelling the material, or combinations thereof.

13. The method of claim 1, wherein the superabsorber's physical size increases by about 10 to about 800 times when released from the container.

14. The method of claim 1, wherein the superabsorber has a particle size of less than or equal to about 14 millimeters.

15. The method of claim 1, wherein the container is osmotically permeable, or osmotically semi-permeable and wherein the container comprises a pig membrane, a cellulose acetate, a cellulose triacetate, a polyamide, a polyamide resin, a polyimide resin, a polyether sulfone, a polysulfone, a polyphenyl sulfone, a polyvinylidene fluoride, or combinations thereof.

16. The method of claim 15, wherein releasing the material comprises bursting the container by swelling the material.

17. The method of claim 1, wherein placing the container comprises lowering the container into the wellbore by a tether and cutting the tether.

18. The method of claim 1, wherein the container comprises a thickness of from about 2 ply to about 10 ply.

19. The method of claim 1, wherein placing the container comprises dropping the container through the drill string.

20. A method of servicing a wellbore in contact with a subterranean formation, comprising: placing a closed container in the wellbore, wherein the closed container comprises a material effective to plugging a flow pathway in the wellbore; and releasing the material from the container, wherein the container comprises a pig membrane, a cellulose acetate, a cellulose triacetate, a polyamide, a polyamide resin, a polyimide resin, a polyether sulfone, a polysulfone, a polyphenyl sulfone, a polyvinylidene fluoride, or combinations thereof.

21. The method of claim 20, wherein the material comprises crosslinked polyacrylamide; crosslinked polyacrylate; crosslinked hydrolyzed polyacrylonitrile; salts of carboxyalkyl starch; salts of carboxyalkyl cellulose; salts of crosslinked carboxyalkyl polysaccharide; crosslinked copolymers of acrylamide and acrylate monomers; starch grafted with acrylonitrile and acrylate monomers; crosslinked polymers of two or more of allylsulfonate, 2-acrylamido-2-methyl-1-propanesulfonic acid, 3-allyloxy-2-hydroxy-1-propane-sulfonic acid, acrylamide, and acrylic acid monomers; or combinations thereof.

22. The method of claim 20, wherein the material's physical size increases by about 10 to about 800 times when released from the container.

23. A method of servicing a wellbore in contact with a subterranean formation, comprising: placing a closed container in the wellbore, wherein the closed container comprises a material effective to plugging a flow pathway in the wellbore; and releasing the material from the container, wherein the material comprises a swelling agent, wherein the swelling agent comprises a superabsorber, and wherein placing the container comprises lowering the container into the wellbore by a tether and cutting the tether.

24. The method of claim 23, wherein the superabsorber comprises at least one sodium acrylate-based polymer having a three dimensional, network-like molecular structure.

25. The method of claim 23, wherein the superabsorber comprises crosslinked polyacrylamide; crosslinked polyacrylate; crosslinked hydrolyzed polyacrylonitrile; salts of carboxyalkyl starch; salts of carboxyalkyl cellulose; salts of crosslinked carboxyalkyl polysaccharide; crosslinked copolymers of acrylamide and acrylate monomers; starch grafted with acrylonitrile and acrylate monomers; crosslinked polymers of two or more of allylsulfonate, 2-acrylamido-2-methyl-1-propanesulfonic acid, 3-allyloxy- 2-hydroxy-1-propane-sulfonic acid, acrylamide, and acrylic acid monomers; or combinations thereof.

26. The method of claim 23, wherein the superabsorber's physical size increases by about 10 to about 800 times when released from the container.

27. A package for plugging a flow pathway in a wellbore, comprising: a swelling agent disposed within a closed container, wherein the swelling agent comprises a superabsorber, wherein the superabsorber comprises a dehydrated, crystalline polymer.

28. The package of claim 27, further comprising a silicate solution disposed within the container.

29. The package of claim 27, further comprising a sealing agent, a weighting material, or combinations thereof disposed within the container.

30. The package of claim 27, wherein the container is porous, semi-porous, osmotically permeable, osmotically semi-permeable, or impermeable.

31. The package of claim 27, wherein the container comprises a polymer.

32. The package of claim 31, wherein the polymer comprises a water soluble or water degradable polymer.

33. The package of claim 32, wherein the water soluble or water degradable polymer comprises a polyvinyl alcohol, a polyvinyl acetate, a hydroxyethyl cellulose, a carboxymethyl cellulose, a sodium carboxymethyl hydroxyethyl cellulose, a methyl hydroxy propyl cellulose, a derivative of polyethylene glycol, a starch, a cellulose triester, a polyethylene oxide, a polyester, or combinations thereof.

34. The package of claim 31, wherein the polymer comprises a polyethylene, a polypropylene, a polyvinylchloride, a polyvinylidenechloride, an ethylene-vinylacetate copolymer, a poly ether, a poly ketone, a styrene-butadiene based latex, or combinations thereof.

35. The package of claim 27, wherein the superabsorber has a particle size of less than or equal to about 14 millimeters.

36. The package of claim 27, wherein the container is osmotically permeable, or osmotically semi-permeable and wherein the container comprises a pig membrane, a cellulose acetate, a cellulose triacetate, a polyamide, a polyamide resin, a polyimide resin, a polyether sulfone, a polysulfone, a polyphenyl sulfone, a polyvinylidene fluoride, or combinations thereof.

37. A method of servicing a wellbore in contact with a subterranean formation, comprising: placing a closed container in the wellbore, wherein the closed container comprises a material effective to plugging a flow pathway in the wellbore; and releasing the material from the container, wherein the material comprises a swelling agent, wherein the swelling agent comprises a superabsorber, wherein the container comprises a water soluble or water degradable polymer, wherein the superabsorber comprises at least one sodium acrylate-based polymer having a three dimensional, network-like molecular structure, and wherein placing the container comprises lowering the container into the wellbore by a tether and cutting the tether.

38. The method of claim 37, wherein the water soluble or water degradable polymer comprises a polyvinyl alcohol, a polyvinyl acetate, a hydroxyethyl cellulose, a carboxymethyl cellulose, a sodium carboxymethyl hydroxyethyl cellulose, a methyl hydroxy propyl cellulose, a derivative of polyethylene glycol, a starch, a cellulose triester, a polyethylene oxide, a polyester, or combinations thereof.

39. The method of claim 38, wherein releasing the material comprises dissolving at least a portion of the container and wherein the superabsorber's physical size increases by about 10 to about 800 times when released from the container.

40. The method of claim 37, wherein placing the container comprises lowering the container into the wellbore by a tether and cutting the tether.

41. A method of servicing a wellbore in contact with a subterranean formation, comprising: placing a closed container in the wellbore, wherein the closed container comprises a material effective to plugging a flow pathway in the wellbore; and releasing the material from the container, wherein the material comprises a swelling agent, wherein the swelling agent comprises a superabsorber, wherein the container comprises a water soluble or water degradable polymer, wherein the superabsorber comprises crosslinked polyacrylamide; crosslinked polyacrylate; crosslinked hydrolyzed polyacrylonitrile; salts of carboxyalkyl starch; salts of carboxyalkyl cellulose; salts of crosslinked carboxyalkyl polysaccharide; crosslinked copolymers of acrylamide and acrylate monomers; starch grafted with acrylonitrile and acrylate monomers; crosslinked polymers of two or more of allylsulfonate, 2-acrylamido-2-methyl-1-propanesulfonic acid, 3-allyloxy-2-hydroxy-1-propane-sulfonic acid, acrylamide, and acrylic acid monomers; or combinations thereof, and wherein placing the container comprises lowering the container into the wellbore by a tether and cutting the tether.

* * * * *